US007839349B1

(12) United States Patent
West

(10) Patent No.: US 7,839,349 B1
(45) Date of Patent: Nov. 23, 2010

(54) TUNABLE SUBSTRATE PHASE SCANNED REFLECTOR ANTENNA

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 491 days.

(21) Appl. No.: 11/637,370

(22) Filed: Dec. 12, 2006

(51) Int. Cl.
*H01Q 13/00* (2006.01)

(52) U.S. Cl. ..... 343/781 CA; 343/786; 343/840

(58) Field of Classification Search ..... 343/755, 343/840, 786, 781 CA, 781 P
See application file for complete search history.

(56) References Cited

U.S. PATENT DOCUMENTS 4,195,301 A * 3/1980 Conroy ..... 343/700 MS
5,689,275 A * 11/1997 Moore et al. ..... 343/786
6,650,291 B1 11/2003 West et al. ..... 342/371
6,756,866 B1 * 6/2004 Higgins ..... 333/157
6,806,846 B1 10/2004 West ..... 343/909

OTHER PUBLICATIONS

Elamaran, B., I. Chio, L. Chen, and J. Chiao, "A Beam-Steerer Using Reconfigurable PBG Ground Plane," Microwave Symposium Digest, 2000 IEEE MTT-S International, vol. 2, pp. 835-838, Jun. 2000.*

Weily, A.R., T.S. Bird, K.P. Esselle, and B.C. Sanders, "Woodpile EBG phase shifter," Electronics Letters, vol. 42, No. 25, Dec. 7, 2006.*

* cited by examiner

*Primary Examiner*—Tan Ho
(74) *Attorney, Agent, or Firm*—Matthew J. Evans; Daniel M. Barbieri

(57) ABSTRACT

In some embodiments, a reflector antenna may include one or more of the following features: (a) a reflector having a tunable reflective surface, (b) a reflector feed having tunable substrate materials, and (c) a sub-reflector.

17 Claims, 13 Drawing Sheets

TUNABLE SUBSTRATE PHASE SCANNED REFLECTOR ANTENNA

FIELD OF THE INVENTION

Embodiments of the present invention relate to antennas. Particularly, embodiments of the present invention relate to reflector antennas. More particularly, embodiments of the present invention relate to electronic-scanned reflector antennas having tunable substrate materials to achieve phase shifting within the reflector feed(s) or sub-reflectors.

BACKGROUND OF THE INVENTION

A traditional metallic waveguide feed 15 for a reflector antenna 10 is illustrated in FIG. 1 and represents the current art in reflector systems for portable communications. Reflector antenna technology is one of the most cost effective and architecturally simple ways to realize high gain, narrow beam width radiation patterns since the electrically large reflector surface 12 is spatially excited from a propagating electromagnetic wave 14 originating from feed antenna 15. An electrically small feed 15 therefore effectively excites an electrically large reflecting surface 12.

A constrained feed phased array antenna, in contrast, is drastically more complex and expensive than reflector technology for the same electrical size due to the large number of interconnects required. Phase scanned lens antenna are also possible, and are less complex and costly than constrained feed phased arrays, however, they also require a large number of radiating elements and RF (radio frequency) interconnects to realize high gain and narrow beam radiation patterns.

Certain systems, such as landing and imaging radars, only need to electronically scan a narrow antenna beam over limited angular sectors. A limited scan reflector system can be appropriate for such applications. The limited scan, electronically scanned reflector utilizes electrically smaller phased array antenna feeds to generate a variable phase excitation to the reflector assembly. This allows limited range beam steering off the reflector's normal axis. The limited scanned reflector utilizes traditional phase shifter based phased array technology, such as microstrip antenna technology.

While all of these antenna systems describe above are useful and work well for their designed applications, all of these antenna technology types have a plurality of limitations, particularly at millimeter (mm) and microwave frequencies.

Therefore, it would be desirable to provide reflector antenna technology that incorporates the benefits of the other antenna systems to provide a low cost antenna that works well at the mm and microwave frequencies.

SUMMARY OF THE INVENTION

In some embodiments, a reflector antenna may include one or more of the following features: (a) a reflector having a tunable reflective surface, (b) a reflector feed having tunable substrate materials, and (c) a sub-reflector. In some embodiments, a reflector antenna may include one or more of the following features: (a) a reflector having a reflective surface, (b) a reflector feed capable of transmitting a signal, and (c) a sub-reflector having a tunable substrate.

In some embodiments, a reflector antenna may include one or more of the following features: (a) a reflector having a reflective surface, (b) a reflector feed capable of transmitting a signal, and (c) a phase scanned lens, (d) an optical modulator.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
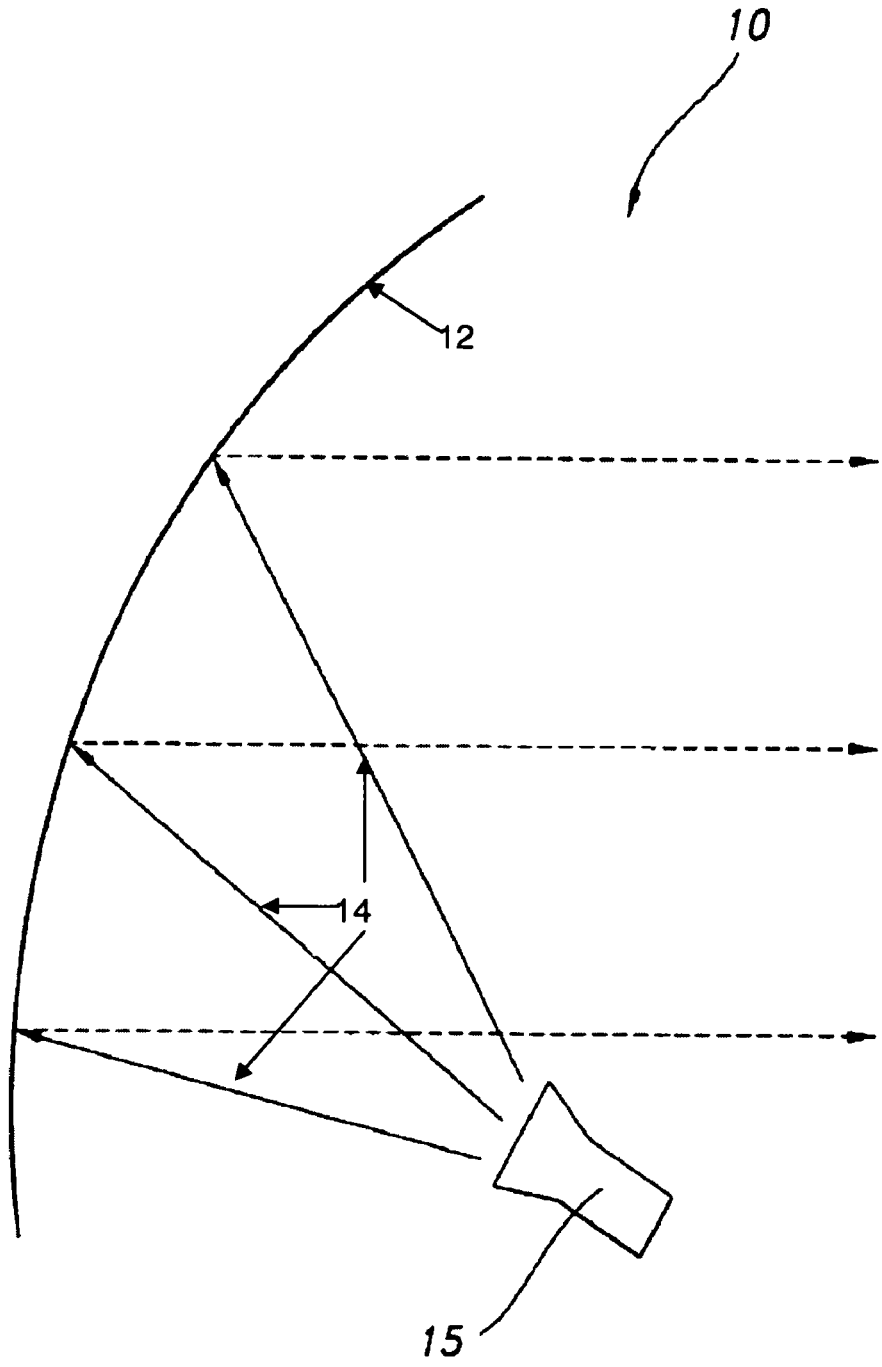
FIG. 1 (Prior Art)
FIG. 1 shows a diagram of a traditional metallic waveguide feed for a reflector antenna and represents the current art in reflector systems for portable communications.

Reference will now be made in detail to embodiments of the invention, examples of which are illustrated in the accompanying drawings.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

Embodiments of the present invention utilize a TEM (transverse electromagnetic) tunable substrate antenna array or phase scanned lens as a reflector feed. Several reflector architectures compatible with this concept are described in detail below. Other embodiments of this technology are described below, including ferroelectric and ferromagnetic waveguide-based TEM photonic band gap (PBG) substrates. Embodiments of the invention described herein utilize this technology to develop phase shifter reflector feeds and sub-reflector panels. Embodiments of the present invention also include reflecting surfaces and sub-reflecting surfaces utilizing frequency agile (e.g., tunable) materials as is described in detail below.

In embodiments of the present invention, the subreflecting and main reflector surfaces of the antenna can be any arbitrary shape, without departing from the spirit of the invention, as long as the frequency agile material has the ability to generate the appropriate reflection phase for wave collimation and beam steering. Curved surfaces, which are discussed in detail below, are based on conventional passive, metallic structures and are only used for instructive purposes. It is fully contemplated that any type of surface, such as planar, convex, or concave surface, could be implemented without departing from the spirit of the present invention. It is also fully contemplated that multiple passive feed horns could be utilized without departing from the spirit of the present invention.

Figure 2:
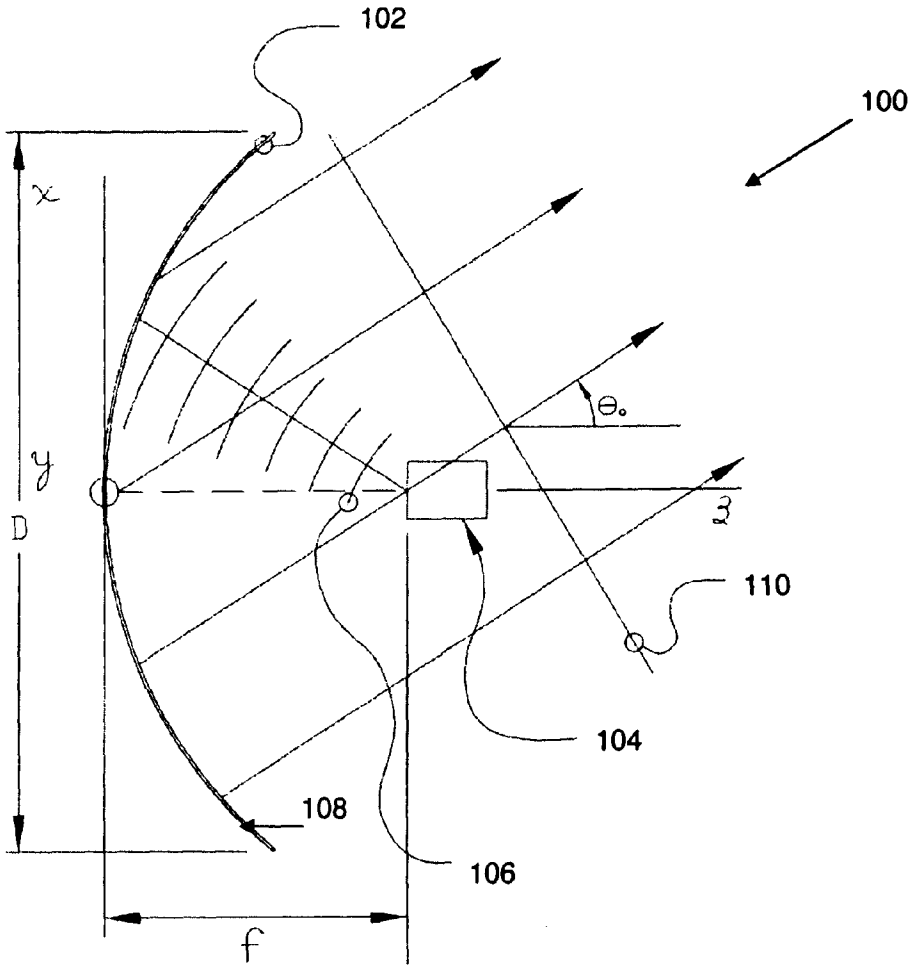
FIG. 2 shows a prime focus limited scan reflector antenna in an embodiment of the present invention.

With reference to FIG. 2, a prime focus limited scan reflector antenna in an embodiment of the present invention is shown. Reflector assembly 100 has a concave reflector 102 and a reflector feed 104. Reflector feed 104 can transmit a signal 106 which excites tunable reflector surface 108 (as discussed in more detail below). In embodiments of the present invention, signal 106 would be reflected as a collimated plane wave 110 that could be electronically directed to any direction desired by the operator of reflector assembly 100. Thus, creating an inexpensive phased array as will be discussed in more detail below.

Reflector 102 can be made of most any material used for reflectors, such as most any conductive material. In addition, the main reflecting surface can be a tunable material to assist in generating the overall phase shifter required to shape the beam. In the present embodiment, reflector feed 104 is an array feed having an array of TEM waveguide radiating elements. Each TEM waveguide radiating element having a PBG or EBG (electromagnetic band gap)/EMXT (electromagnetic crystal) phase shifter waveguide. Thus an embodiment to steer signal 106 could be by use of tunable PBG structures. It is contemplated that the phased array shown in FIG. 2 can be of general phased array architecture.

Figure 3A:
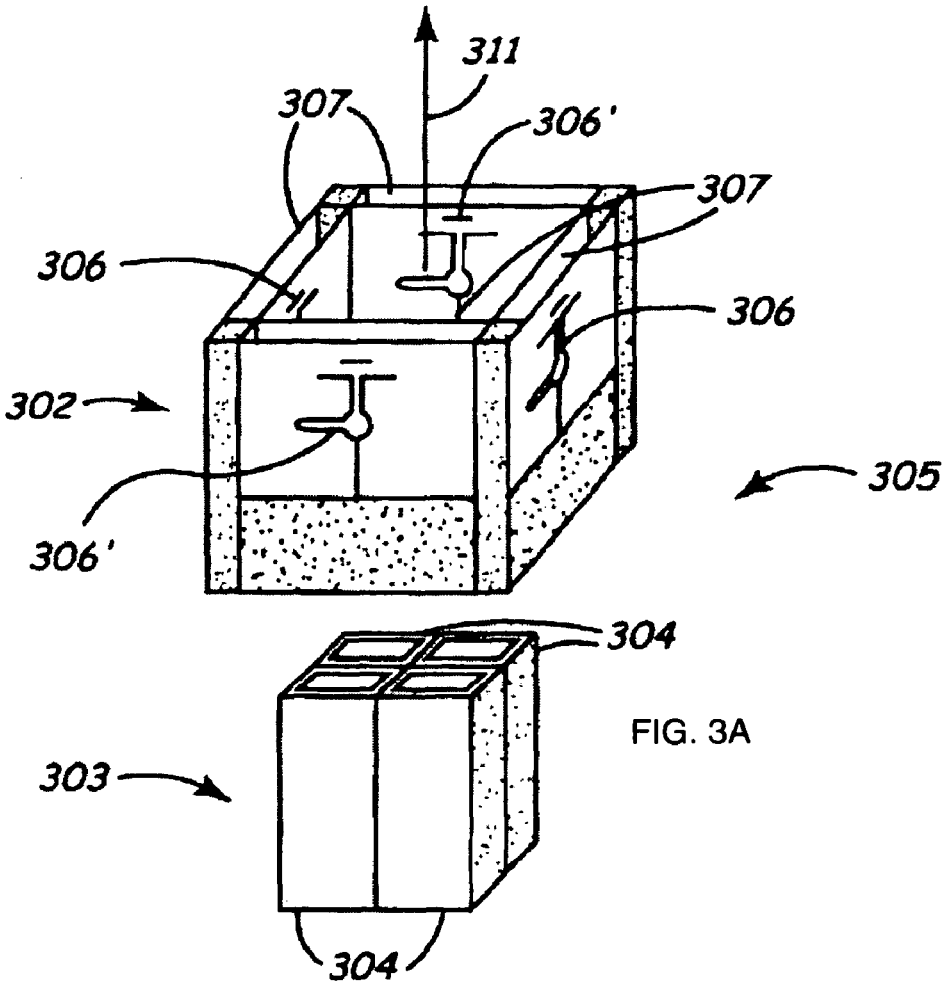
FIG. 3*a* is an isometric view of a TEM square waveguide radiators in an embodiment of the present invention.
Figure 3B:
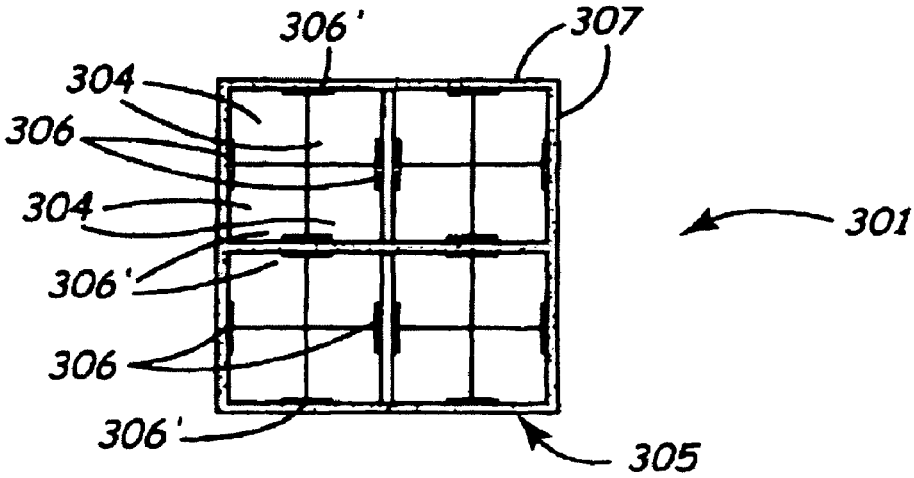
FIG. 3*b* is a top view of a three-band wideband phase sub-array comprising four cells of FIG. 3*a* in am embodiment of the present invention.

FIG. 3*a* shows a single cell 305 used in forming a phased array antenna feed 10. FIG. 3*b* illustrates a wideband sub-array 301 comprising four cells 305 that may cover the millimeter frequencies depending on the bandwidth of the chosen radiating elements. An isometric view of a single cell 305 is shown in FIG. 3*a* and a top view of the sub-array 301 is shown in FIG. 3*b*.

In cell 305 in FIG. 3*a* band coverage, as across the 30 to 300 GHz, is provided by end-fire radiating elements 306 and 306' etched on four double-sided printed circuit board 307 walls positioned with pairs of walls parallel to each other and parallel pairs of walls perpendicular to each other to form a low frequency band radiating assembly 302. Each radiating element in FIG. 3*a* is shown as quasi-Yagi end-fire radiating elements 306 and 306'. The assembly 302 has quasi-Yagi radiating element 306 and 306' on each inner printed circuit board 307 surface with a radiation direction out on open end as shown by arrow 311. The printed circuit boards 307 of the cell 305 may also have the quasi-Yagi radiating elements 306 and 306' of an adjacent cell 305 on the outer circuit board 307 surfaces as shown in FIG. 3*b*. Cell 305 may share the quasi-Yagi radiating elements 306 and 306' with adjacent cells with only one element disposed between the cells 305.

In each cell 305, open-ended square waveguides 304 form a high frequency band radiating assembly 303 positioned at an open input end of the low frequency assembly 302 as shown in FIG. 3*a*. Waveguides 304 are used for single band coverage of one of the high frequency bands, such as 30 and 40 GHz, FIG. 3*b* shows a top view of the sub-array 301 comprising four cells 305. Four cells 305 are shown in the sub array 301 of FIG. 3*b* but any number may be used. The quasi-Yagi end-fire radiating elements 306 and 306' are located on the walls of printed circuit boards 307 as described above. Printed circuit boards 307 form the walls of adjacent low frequency assemblies 302 in an egg crate fashion. Circular polarization (CP) may be achieved by driving vertical polarized and horizontal polarized printed elements in phase quadrature. In a single cell 305, vertical Yagis 306 are driven with one phase and horizontal Yagis 306' are driven in phase quadrature to achieve circular polarization. Good axial ratio performance is realized even though the electrical phase centers of vertical polarization 306 and horizontal polarization radiating elements 306' are displaced from one another as shown in FIG. 3*a*. Further improvement in axial ratio may be possible using phase shift compensation as part of a beam steering algorithm of the phased array. Additionally, two separate polarizations to realize a dual linear polarization antenna are also possible.

A preferred phase shifting method for waveguide 304 to steer signal 106 is by means of tunable PBG structures. Tunable PBG phase shifting material is embedded with waveguide assembly 304. Photonic band gap structures are periodic dielectric structures that forbid propagation of electromagnetic waves in a certain frequency range. Phase shifting is obtained by modulating the surface impedance of the PBG material on the waveguide walls. Several approaches to tunable PBG material are currently being studied including ferroelectric material based substrates, ferromagnetic based substrates, varactor diode loaded PBG substrates, or MEMS (Micro-Electro-Mechanical Systems) based PBG structures.

Figure 4:
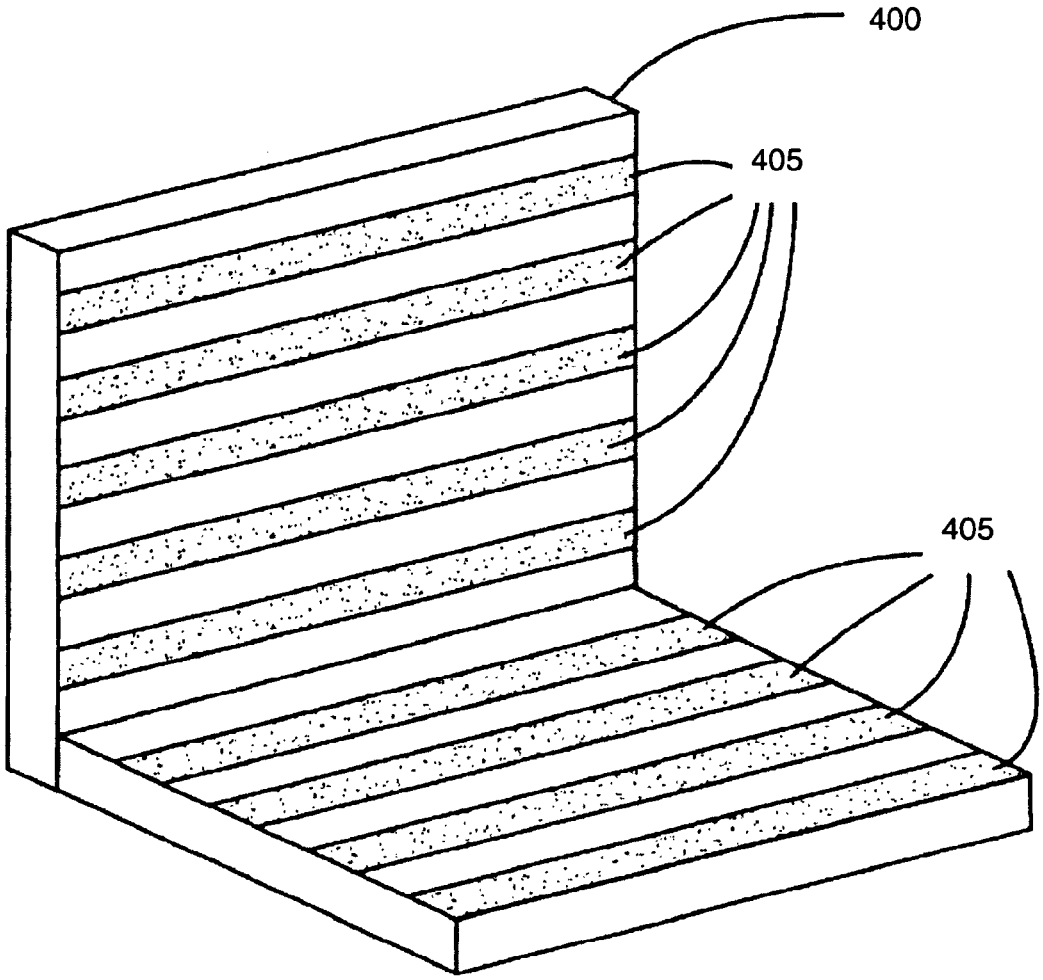
FIG. 4 is a diagram showing a phase shifter using photonic band gap materials for use in an embodiment of the present invention.

FIG. 4 shows an embodiment of a tunable PBG material phase shifting waveguide 400 for beam forming. For simplicity, only two walls of waveguide 400 are shown in FIG. 4. Linear polarized phase shifting is realized when two narrow walls of the waveguide are lined with PBG material. Circular polarization may be obtained by differential phase shifting of orthogonal radiating E field components within waveguide 400. Stripe high impedance planes 405 on all four walls support two orthogonal TEM waves in FIG. 4. Phase shifting is obtained by means of the tunable PBG material in stripe high impedance planes 405 located on the walls of waveguide 400. Alternately, the phase shift function may be obtained with MEMS switch-based broadband true time delay (TDD) devices. MEMS can be integrated in an EBG waveguide type structure, or can be utilized in a planar microstrip or stripline TDD embodiment. MEMS can be integrated into a EBG waveguide type structure, or can be utilized in a planar microstrip or stripline TDD embodiment.

Cell 305 that makes up TEM waveguide feed 104 may be fed by a variety of methods. Constrained feed manifolds, such as microstrip or stripline technology, may be used to excite each of waveguides 304 and the end-fire radiating elements 306, 306'. The number, spacing, and size of the waveguides can be adjusted to properly illuminate reflector surface 108 for a given operating frequency band.

TEM waveguide radiating elements with PBG phase shifting properties are well know in the art and discussed in U.S. Pat. No. 6,650,291 titled Multiband Phased Array Antenna Utilizing a Unit Cell herein incorporated by reference in its entirety. By shifting the phase of signal 106 utilizing the PBG material, collimated plane wave 110 can be directed in most any chosen direction. Thus creating an inexpensive phased array antenna.

Figure 5:
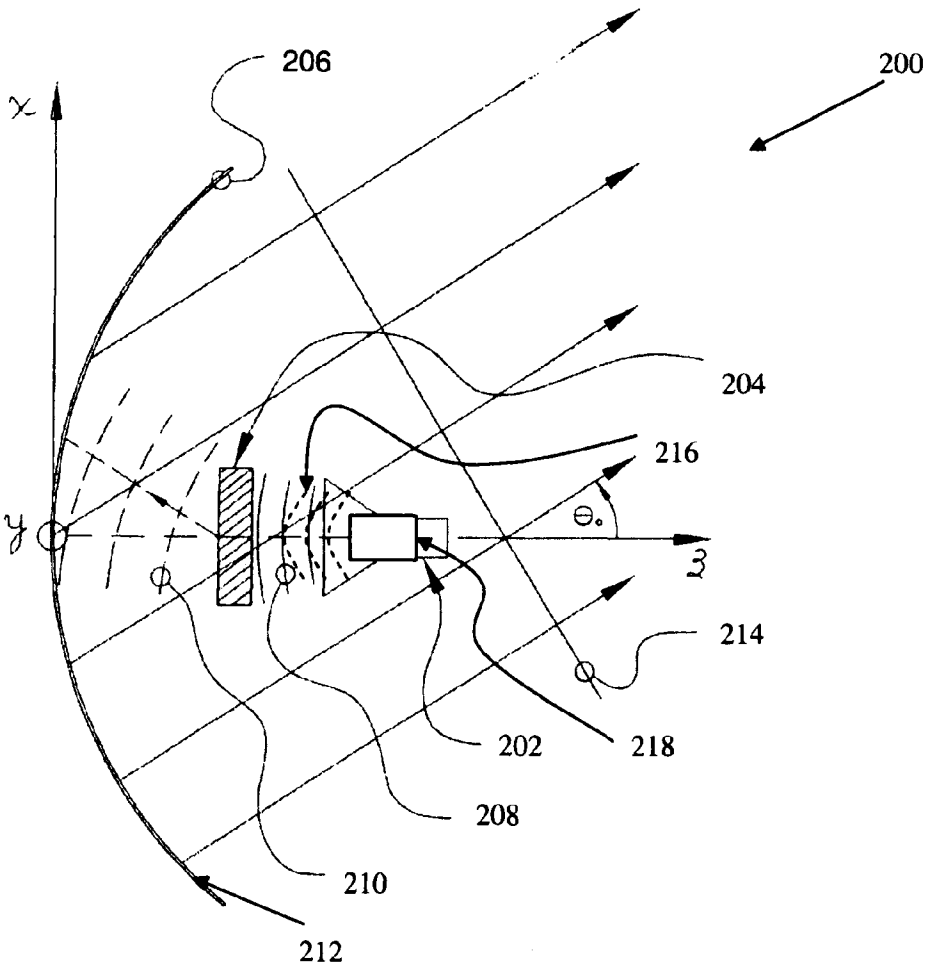
FIG. 5 shows a diagram of a prime focus phase scanned lens antenna in an embodiment of the present invention.

With reference to FIG. 5, a prime focus phase scanned lens antenna in an embodiment of the present invention is shown. Antenna 200 has a passive feed antenna 202, a phase scanned lens 204, and a reflector 206. In operation, passive feed antenna 202 transmits a standard signal 208 (e.g., a signal that is not phase shifted) to phase scanned lens 204. The phase scanned lens 204 acts to create a phase shift in signal 208 and create a phase shifted signal 210 that excites surface 212 of reflector 206. Phase shifted signal 210 is then reflected off of reflector 206 and emitted as collimated plane wave 214 steered to ($\Theta_0$, $\varnothing_0$). Reflector 206 can also be a frequency agile material to assist in the overall phase shifting, beam steering mechanism. Reflector 206 can also be a frequency agile material to assist in the overall phase shifting, beam steering mechanism without departing from the spirit of the invention.

Figure 6:
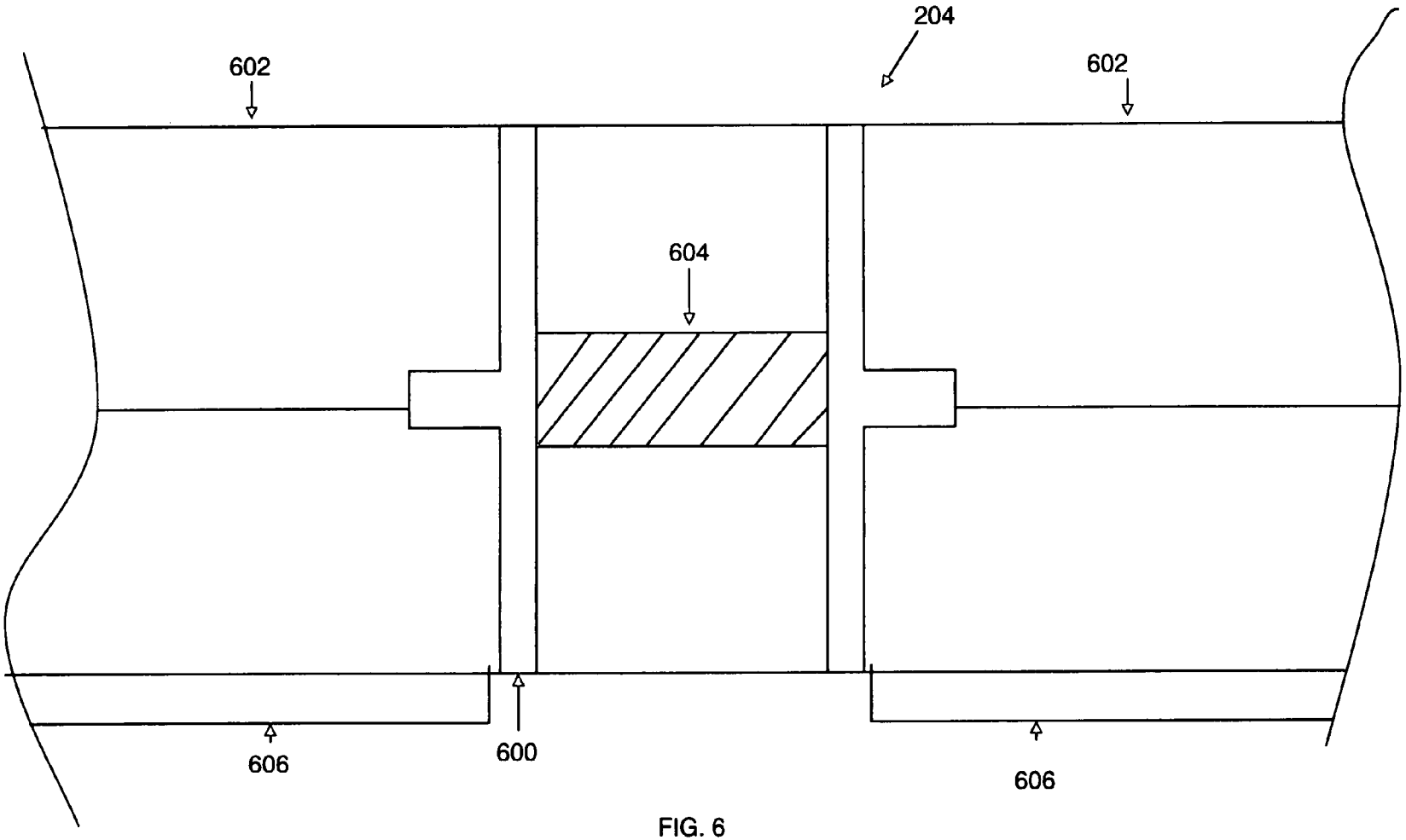
FIG. 6 shows a cut away portion of a phase scanned lens in an embodiment of the present invention.

With reference to FIG. 6, a cut away portion of a phase scanned lens in an embodiment of the present invention is shown. Phase scanned lens 204 can be generally conformal, of which planar, cylindrical, spherical surfaces are subsets. Phase scanned lens 204 can be based on a modular unit-cell 600 radiating elements inserted on a mechanical support structure 602 that properly spaces adjacent unit-cell elements relative to one another. Each integrated radiating element phase shifter assembly 600 "plugs into" mechanical structure 602 that forms the contour of the lens surface.

In an embodiment utilizing optical beam steering control, the integrated phase shifter/radiating element 600 also includes optical demodulator circuitry 604. The array lattice can be triangular, rectangular, or any arbitrary, non-uniform spacing. Lens support structure 602 can be manufactured in a number of ways, including injection molding of plastic parts, traditional machining techniques, casting, and others. Lens 204 can be excited in the follow ways; space feed with a feed antenna or array (as shown in FIG. 5), PBG sectoral TEM or traditional waveguide horns for fan beam applications, or PBG pyramidal TEM or traditional waveguide horns for pencil beam applications. Passive directional arrays and/or ESAs can also be used to excite the phase shifting lens without departing from the spirit of the invention.

Signal 208 steering control of lens 204 can be realized by radiating light waves 216, which excite each unit-cell 600. An optical modulator 218 resides adjacent feed antenna 202. Beam steering commands are modulated onto a light wave carrier 216 and are transmitted toward each unit-cell 600 in lens 204. Unique light waves are transmitted to each unit-cell 600 to control the array. Each unit-cell assembly 600 has an optical demodulator 604 to translate the beam steering control commands. The array surface contains bias circuitry, which sets the nominal "quiescent point" or nominal bias for each radiating element/phase shifter assembly 204. Optical control signals are used to set command to change phase shift depending on the type of phase shifter mechanism used. This embodiment allows for a straight forward adjustment in the array size and shape without additional RF feed network and beam steering network complexity. The nominal bias for unit-cell 600 is routed through array frame support structure 602 by a flexible printed circuit interconnect board (PCB) 606. PCB 606 is conformably attached to the interior surface of the lens, or embedded into the interior of the lens, and is connected to each unit-cell 600.

In another embodiment, the optical signals are distributed by means of a fiber cable network, with fiber optic connections between the beam steering network and unit-cell 600. The fiber optic cables are routed on the interior surface of the array support frame, or, alternatively, the optic cable could be molded or otherwise integrated into the array support frame. In yet another embodiment, bias signals to each unit-cell 600 are distributed by a flexible, printed circuit interconnect board. This PCB is conformably attached to the interior surface of the lens or embedded into the interior of the lens and is connected to each radiating element, similar to the scheme to bring nominal bias to each radiating element/phase shifter assembly.

Unit-cell 600 has three RF possible embodiments: 1) a spatial power combined TEM waveguide; 2) a ferroelectric material loaded waveguide integrated radiating element/phase shifter assembly, and 3) a tunable PBG phase shifting structure within a waveguide assembly. In the power spatial combined approach, a grid of either MMIC (Monolithic Microwave Integrated Circuits) power amplifier circuits, or LNAs (low noise amplifier), reside on a common semiconductor substrate suspended in a TEM waveguide perpendicular to the waveguide propagation direction to form a TEM excited waveguide/radiating element. The amplifier grid receives the signal, amplifies it, and transmits out the output of the TEM waveguide. Varactor diodes embedded in the PBG material waveguide side walls are used to change the frequency response of the PBG material to initiate phased shift and polarization diversity. It is also possible to use a ferroelectric material loaded photonic band gap material to realize phase shift and polarization diversity, rather than varactor loaded PBG materials.

The embodiment of FIG. 5, the Quasi Optic semiconductor amplifier grid approach can be used to realize an active feed for both transmit and receive applications. This can be helpful for the following scenarios: minimizing loss to maximize loop gain for communications or radar system, reduction of reflect array axial dimension (the axis of the focal distance) for applications with tight space requirements, and minimizing feed blockage in a system requiring the receiver front end or transmitter output be attached directly to the feed for loss minimization. Both sum beam and monopulse feed implementations can be incorporated in the basic design of each of the limited scanned reflector antenna previously described.

Therefore, as stated above, feed antenna 202 can transmit signal 208 to phase scanned lens 204. Optical modulator 218 will transmit light waves 216 to scanned lens 204. Light waves 216 will carry information on how lens 204 is to phase shift signal 208. Unit-cell 600 will receive these instructions and phase shift signal 208 which results in unit-cell 600 transmitting phase shifted signal 210. Phase shifted signal 210 will then reflect off of reflector 206 in collimated plane wave 214. Thus an inexpensive phased array is realized.

Figure 7:
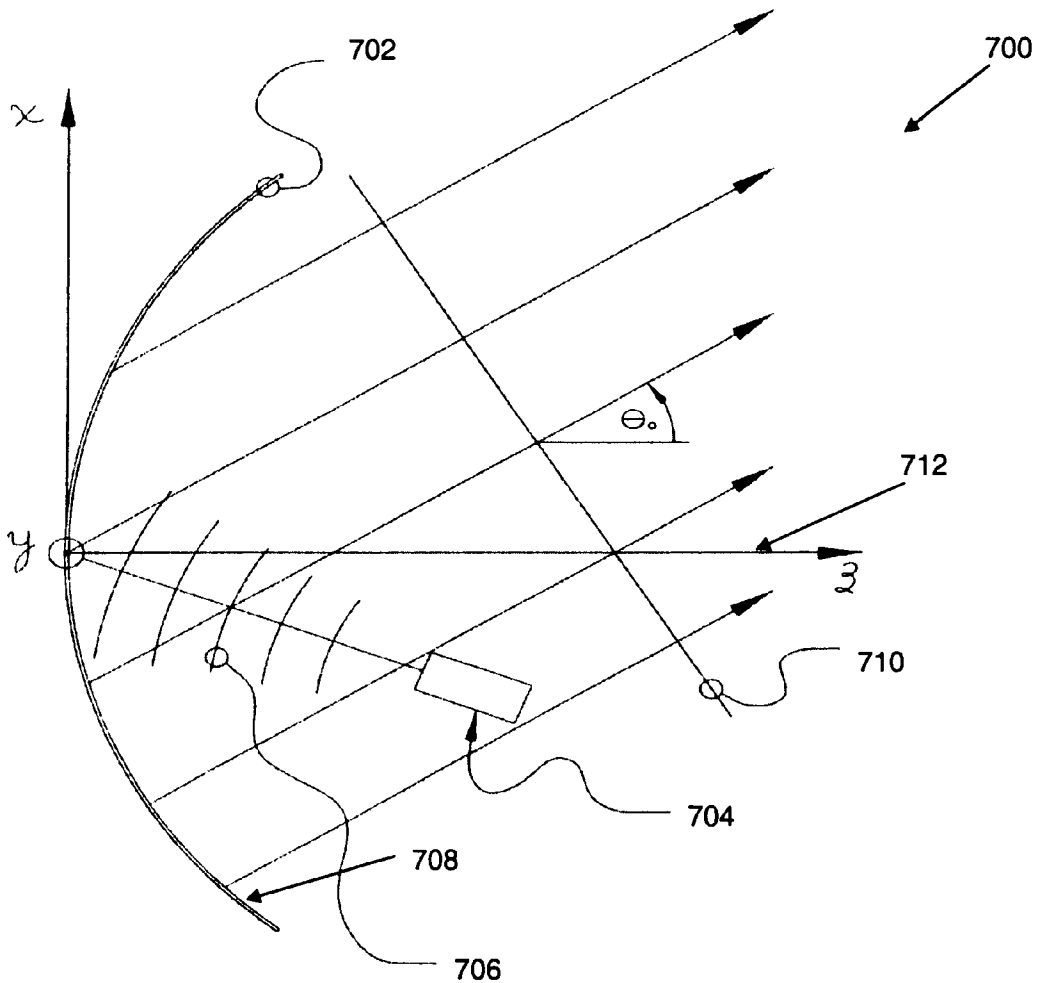
FIG. 7 shows an offset feed embodiment of the present invention.

With reference to FIG. 7, an offset feed embodiment of the present invention is shown. Similar to FIG. 1, Reflector antenna 700 has a reflector 702 and reflector feed 704. Reflector feed 704 can be a frequency agile material based phased array, such as feed 104 of FIG. 1. Feed 704 transmits a phase shifted wave 706 to reflector surface 708 which reflects phase shifted wave 706 as a collimated plane wave 710. This embodiment is similar to the embodiment of FIG. 1 except feed 704 is offset from center axis 712. Reflector 702 can also be a frequency agile surface to participate in the overall phase shifting mechanism required to collimate and steer the beam without departing from the spirit of the invention. Reflector 702 can also be a frequency agile surface to participate in the overall phase shifting mechanism required to collimate and steer the beam.

Figure 8:
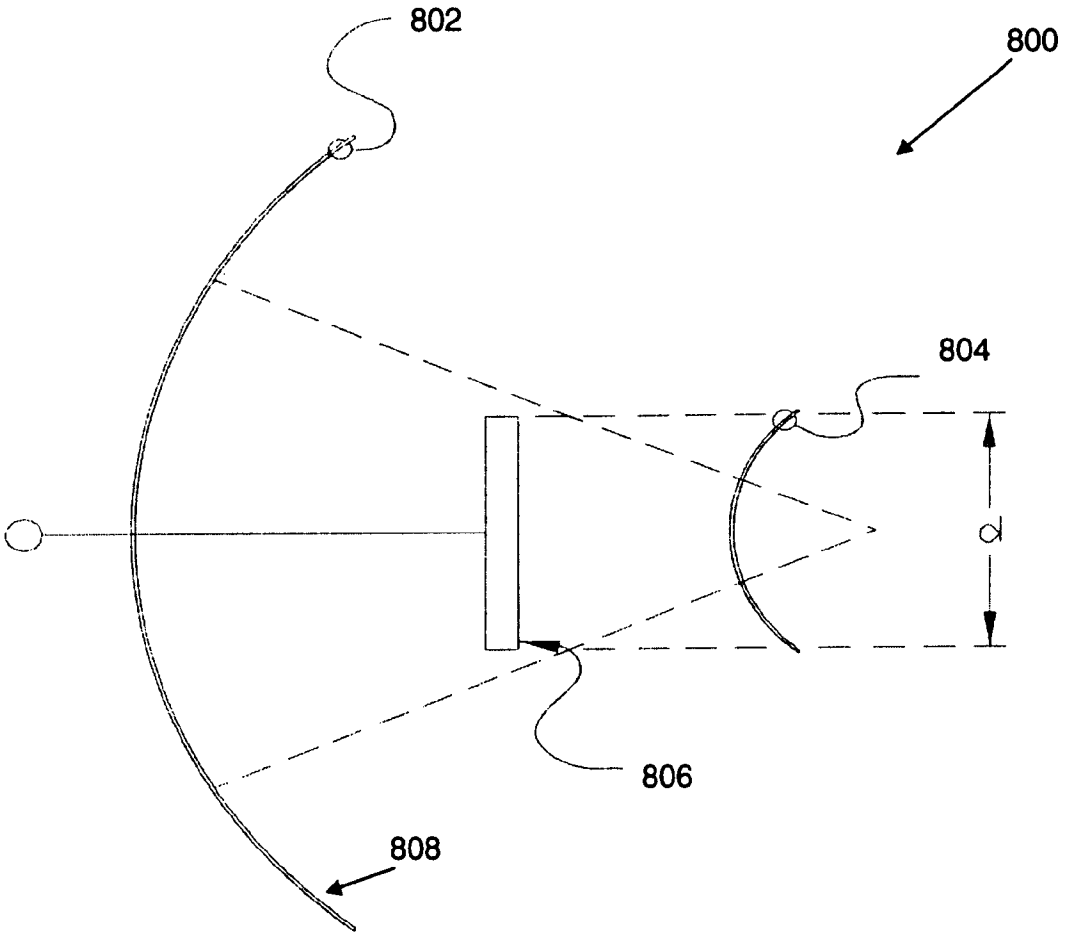
FIG. 8 shows a Cassegrain feed embodiment of the present invention.

With reference to FIG. 8, a Cassegrain feed embodiment of the present invention is shown. In this configuration reflector feed 806 is a phased array while both sub-reflector 804 and reflector 802 are passive conducting surfaces. Reflector antenna 800 has a reflector 802, sub-reflector 804, and reflector feed 806. Similar to the embodiment of FIG. 1, reflector feed 806 is a frequency agile materials based phased array. In operation, reflector feed 806 transmits a phase shifted signal to sub-reflector 804. The phase shifted signal reflects off of sub-reflector 804 and onto reflector surface 808 where it is reflected again into a collimated plane wave directed towards a desired direction. Sub-reflector 804 can be made of the same materials as reflector 802 or it could be made from different materials without departing from the spirit of the invention. It is helpful if both the main reflector and subreflector are made from frequency agile tunable material to assist in the overall wave collimation and beam steering. The present embodiment provides for: a compact structure, multiple tunable surface to generate phase shift, the RF electronics are on the back of the main reflector and do not initiative blockage, as in the case of a prime focus design, and all other benefits associated with the conventional, passive Cassegrain reflector design. A helpful aspect is that both the main reflector and sub-reflector can be made from frequency agile, tunable material to assist in the overall wave collimation and beam steering. The Cassegrain has the following features: it is a compact structure, it has multiple tunable surfaces to generate phase shift, the RF electronics are on the back of the main reflector and do not initiative blockage, as in the case of a prime focus design, and all other advantages that are associated with the conventional, passive Cassegrain reflector design. Feed 806 can also be a passive horn with one or both of the subreflector and main reflector being frequency agile (tunable) materials.

Figure 9:
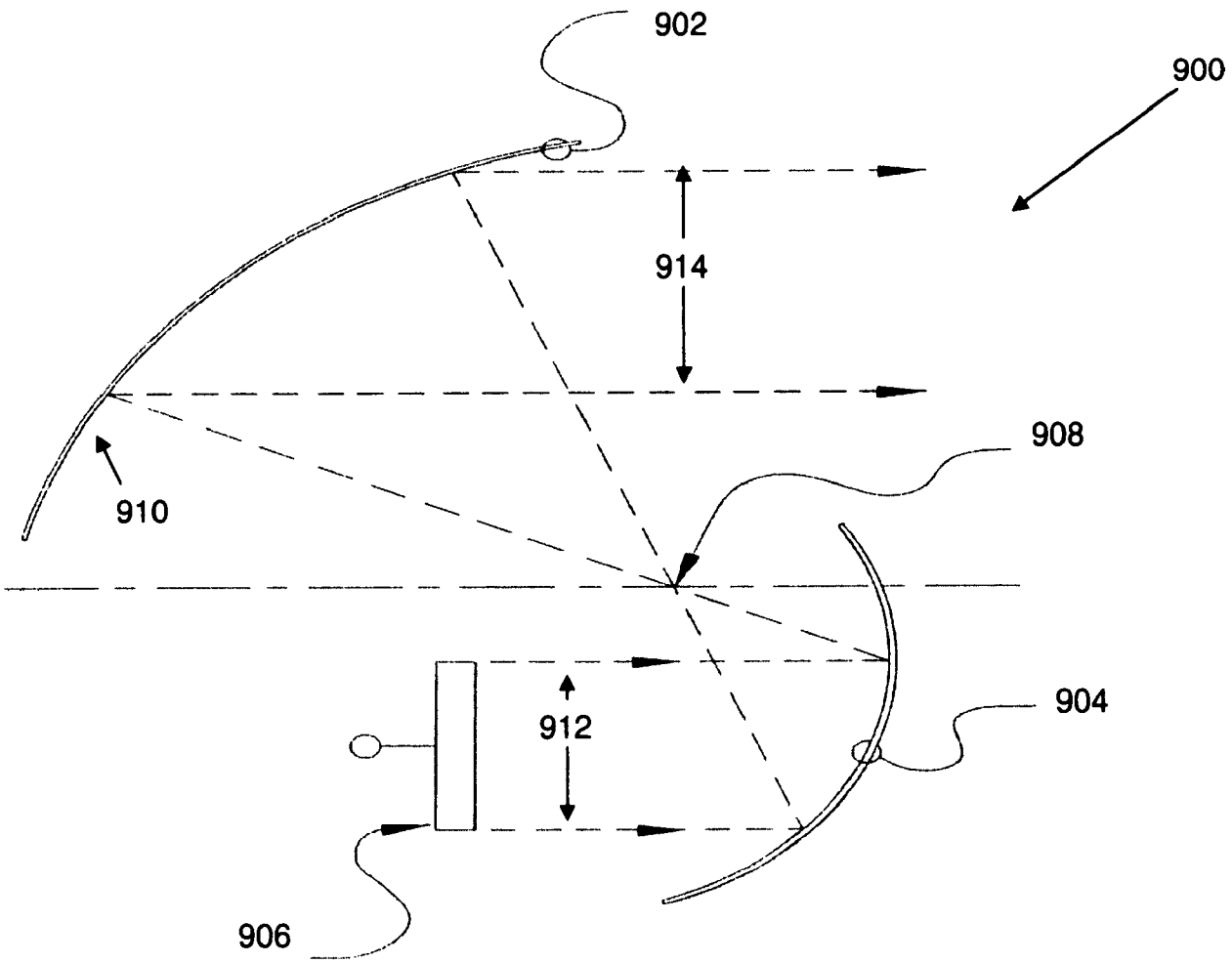
FIG. 9 shows an offset reflector feed embodiment of the present invention.

With reference to FIG. 9, an offset reflector feed embodiment of the present invention is shown. Reflector antenna 900 has a reflector 902, sub-reflector 904, and reflector feed 906. Similar to FIG. 8, reflector feed 906 is a frequency agile materials based phased array. In operation, reflector feed 906 transmits a phase shifted signal 912 to sub-reflector 904, which is a purely passive reflecting surface. Sub-reflector 904 reflects phase shifted signal 912 through common focal point 908 to reflector 902. Reflector 902 is also a purely passive reflecting surface and reflects phase shifted signal 912 off of reflecting surface 910 and results in a collimated phase shifted wave 914. Reflector feed 906 is offset from reflector 902 similar to the embodiment of FIG. 7. It is helpful that both the main reflector and subreflector can be made from frequency agile, tunable material to assist in the overall wave collimation and beam steering. The offset reflect has all of the benefits associated with the conventional, passive offset reflector design (e.g., minimum blockage, beam shaping, polarization advantages, etc.) and the present embodiment has the following benefits: a compact structure, multiple tunable surface to generate phase shift, and the RF electronics are on the back of the main reflector and do not initiative blockage as in the case of a prime focus design.

Figure 10:
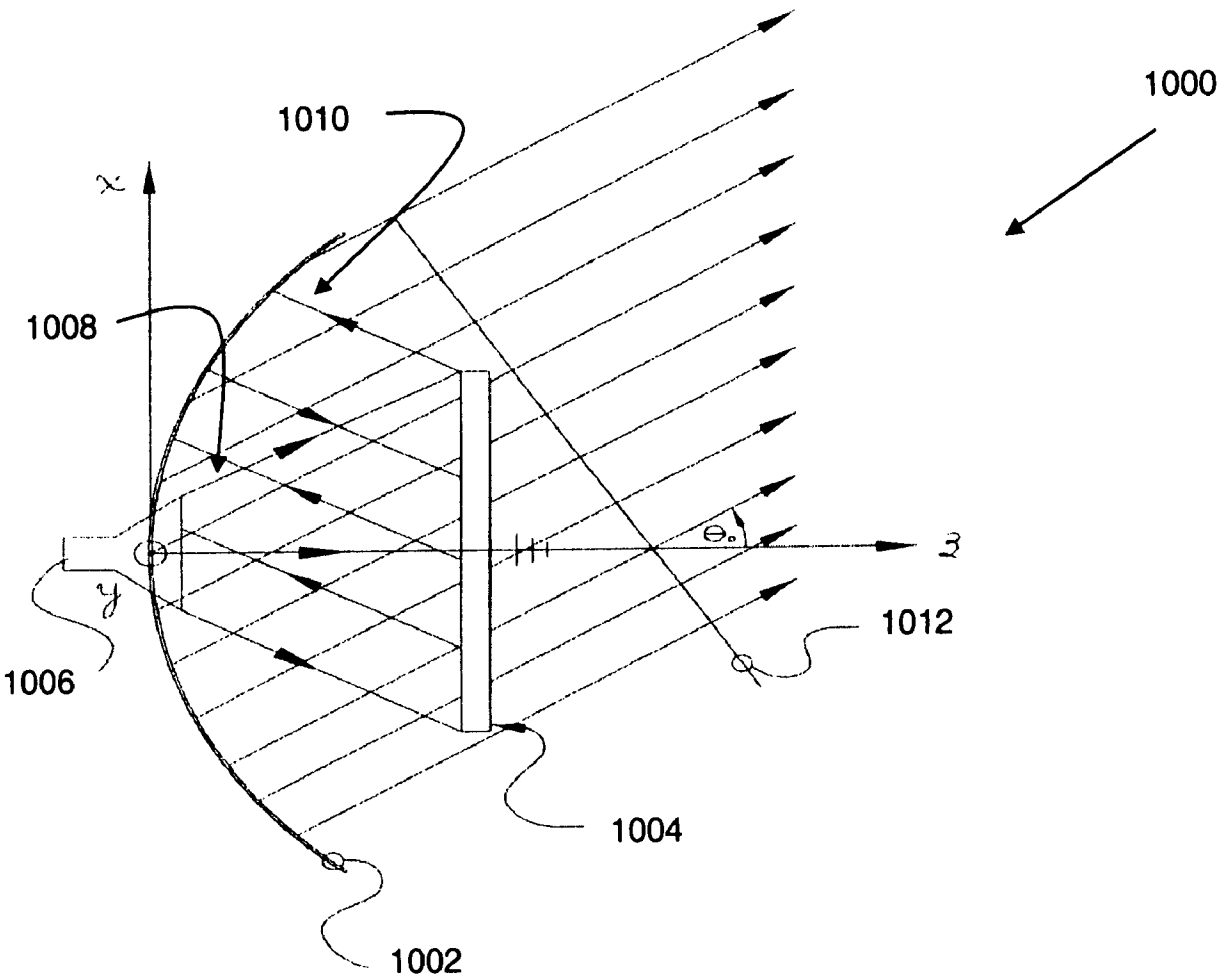
FIG. 10 shows a reflect-array tunable Cassegrain embodiment of the present invention.

With reference to FIG. 10, a reflect-array tunable Cassegrain embodiment of the present invention is shown. In this embodiment, a variation of the multiple-reflector Cassegrain architecture is shown. Reflector feed 1006 is passive, sub-reflector 1004 is a phase-scanned reflect array, and reflector 1002 is a passive conducting surface. Reflector antenna 1000 can have a reflector 1002, a sub-reflector 1004, and a reflector feed 1006. In operation, reflector feed 1006 transmits a standard signal 1008 to sub-reflector 1004. Sub-reflector 1004 is a tunable substrate material based reflect array as are the other phase shifting materials discussed above and the materials will be described in more detail below. Traditional reflect-array architectures are also applicable without departing from the spirit of the invention. There are numerous ways to realize a phased scanned reflect-array by using frequency agile materials. Sub-reflector 1004 will reflect standard signal 1008 as a phase shifted signal 1010. Phase shifted signal 1010 is then reflected off of reflector 1002 as collimated plane wave 1012. It is helpful that several reflect-array architectures presently used can be used in this embodiment. Reflector 1002 can be tunable material surface without departing from the spirit of the invention.

Figure 11:
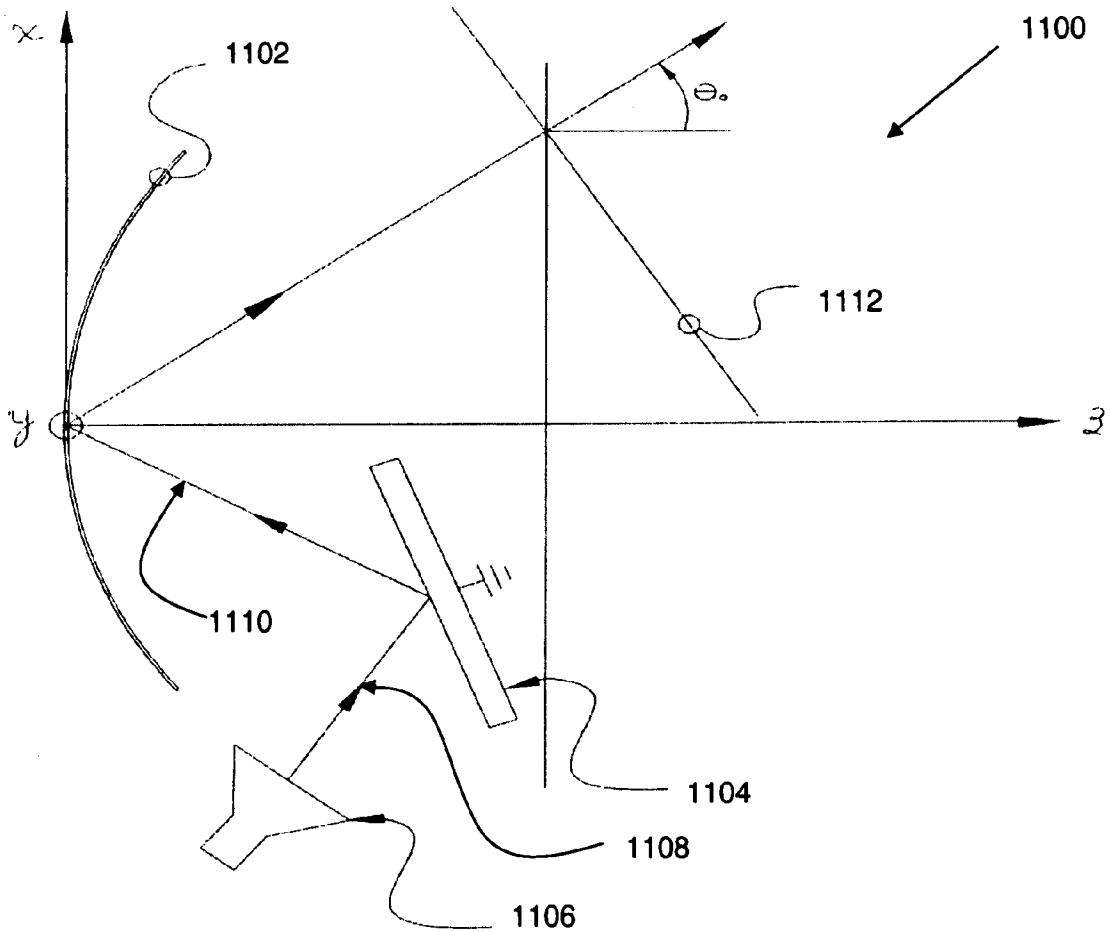
FIG. 11 shows a reflect-array offset feed embodiment of the present invention.

With reference to FIG. 11, a reflect-array offset feed embodiment of the present invention is shown. Reflector antenna 1110 can have a reflector 1102, a sub-reflector 1104, and a reflector 1106. Reflector feed 1106 is a passive feed antenna and is set offset from reflector 1102. The passive antenna feeds discussed in this disclosure for all the limited scan-array reflect array embodiments are similar in design and function as those of the traditional reflector technology. In operation, reflector feed 1106 transmits standard signal 1108 to sub-reflector 1104. Sub-reflector 1104 set offset from reflector 1102, is a frequency agile materials based reflect array. Standard signal 1108 is reflected off of sub-reflector 1104 as a phase shifted signal 1110. Phase shifted signal is then reflected off of reflector 1102 as collimated plane wave 1112. It is helpful that both the main reflector and subreflector can be made from frequency agile such as tunable material to assist in the overall wave collimation and beam steering. The offset reflect has all of the benefits associated with the conventional, passive offset reflector design (e.g., minimum blockage, beam shaping, polarization advantages, etc.) and the present embodiment has the following benefits: a compact structure, multiple tunable surfaces to generate phase shift, and the RF electronics are on the back of the main reflector and do not initiative blockage, as in the case of a prime focus design.

Figure 12:
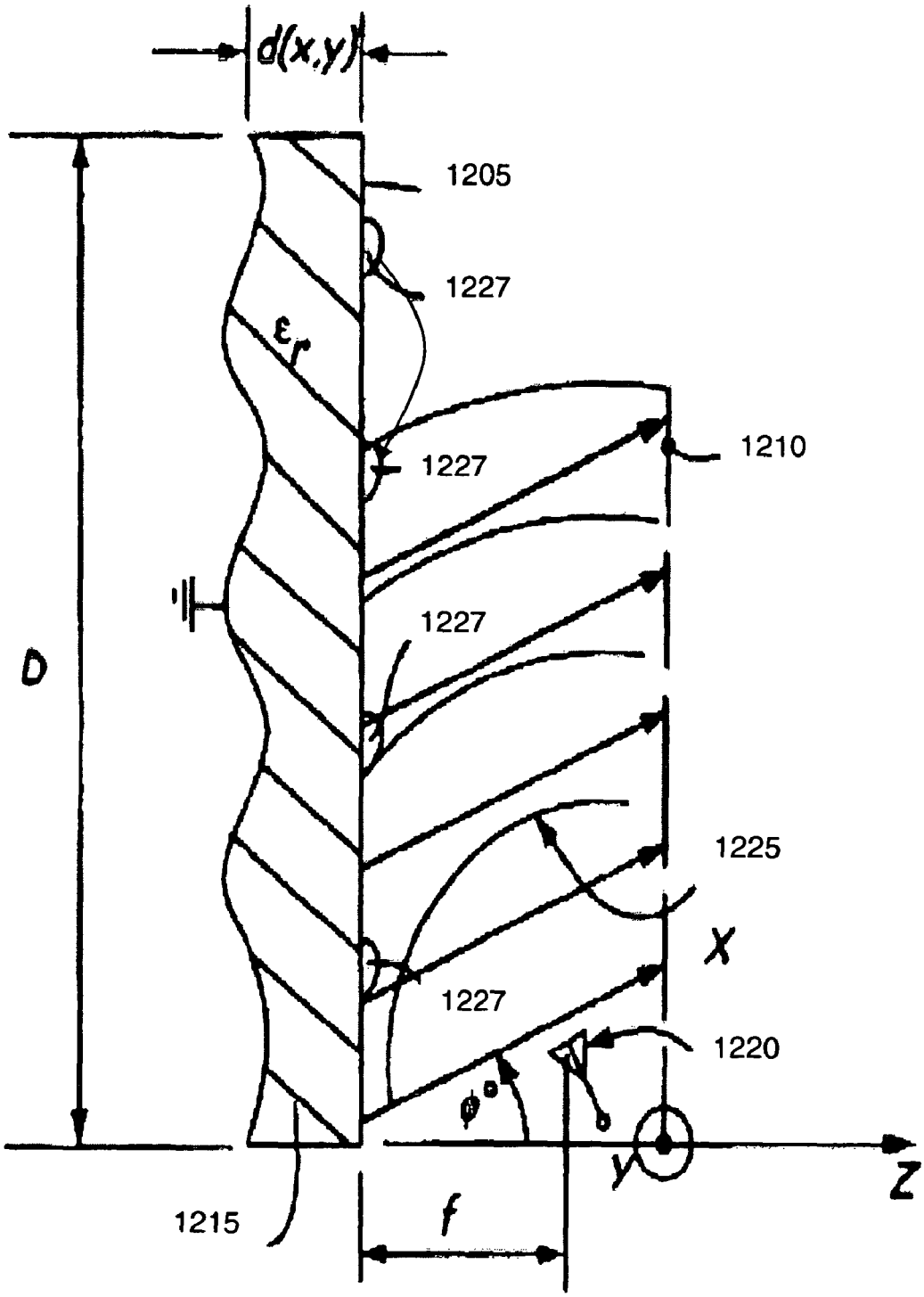
FIG. 12 shows a diagram of a monolithic substrate reflect array in an embodiment of the present invention.

With reference to FIG. 12, a diagram of a monolithic substrate reflect array in an embodiment of the present invention is shown. The tunable substrate material based reflect-array can have two basic implementations illustrated in FIGS. 12 and 13. There are numerous ways to realize a phased scanned reflect-array by using frequency agile materials. Many number of ways are described in U.S. Pat. No. 6,806,846 titled Frequency Agile Material-Based Reflect-array Antenna, herein incorporated by reference in its entirety.

The first implementation to vary a surface impedance of a substrate is to vary the phase shift by using a tunable dielectric substrate or a tunable PBG substrate reflecting surface. In the second Implementation shorted transmission line sections or waveguides are used for feeding the radiating elements. Phase shift is obtained in the shorted waveguide by variable phase shifters using tunable dielectric substrates or PBG substrates or by electronic adjustment of the length of the shorted transmission line sections by means of piezoelectric technology.

In the tunable dielectric substrate reflecting surface embodiment of the first approach the surface impedance of the dielectric slab 1215 of FIG. 12 is electronically modulated by adjusting the material properties of the dielectric constant of the ferroelectric materials or permeability of ferromagnetic materials. The term ferroelectric is used in the general sense throughout this description and is used for material operation within either ferroelectric or paraelectric phases. Ferroelectric materials include bulk crystal, ceramic and thin film materials common in the art. Ferromagnetic materials include ceramic and thin film materials.

Non-uniform fixed surface impedances are obtained by differences in thickness d of the grounded dielectric slab 1215 in two dimensions. The surface impedances are not dynamically variable to scan the radiated beam. In one embodiment of the present invention, a methodology is implemented to modulate the surface impendence of the dielectric slab 1215 by electrically adjusting dielectric constant, $\in_r$, or permeability, $\mu_r$, material parameters. Substrate 1215 material may be either of uniform thickness, d, or also different over certain regions if required to obtain desired surface impedances.

The dielectric constant, $\in_r$, for a grounded ferroelectric slab 1215 in FIG. 12 is adjusted by varying a DC electric field (voltage) within the ferroelectric substrate. The DC bias is provided to the top surface of the ferroelectric material by thin, selective plating or deposition of indium tin oxide (ITO) traces 1227 or other suitable traces in FIG. 12. The composition of the deposition is designed to provide DC voltages to the top-side of the ferroelectric material while simultaneously providing a minimal perturbation to the RF energy being reflected off the surface.

Depositions are made on the slab by using microelectronic and thin film technology that offer the advantages of low cost, compact design, light weight, and highly accurate electrode spacing. Current technology is available to deposit submicron thickness indium tin oxide strips on layers of electrically active material with densities of approximately 200 lines per centimeter, so that the electrode spacing and accuracy necessary for millimeter waves can readily be achieved. Such strips cause only a negligible loss to the propagating beam.

Another method is to tune by electrically adjusting the permeability, $\mu_r$, of a grounded ferromagnetic (ferrite) slab 1215 by varying a DC magnetic field within the ferrite substrate. Individual sections of ferrite substrate each with an independent DC H-field bias can be assembled in a mosaic panel fashion to implement a surface impedance adjustment. The DC bias can be applied in several ways, including placing individual electromagnets behind each ferrite section. Techniques similar to those used in planar transformer technology for contemporary DC-DC power converter applications known in the art may be used. A "panelized" EBG or PBG structure can be used over a planar surface to realize a contiguous tunable-impedance surface. This can be accomplished with printed circuit board metalized planar microstrip type printed wiring board structures with lumped tuning element such as variable capacitance tuning diodes, ferroelectric tunable ship capacitors, or other RF/microwave/millimeter wave tunable inductive or capacitive devices of the appropriate physical size relative to the EBG dimensions.

Ferroelectric and ferromagnetic materials are currently the only materials whose electrical parameters of relative permittivity and/or permeability can be altered or tuned by means of an external stimulus such as a DC bias field. It should be noted, however, that the reflect array concepts described herein are equally applicable to any new, yet to be discovered materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth the Czochralski crystal pulling technique that is known within the art to grow germanium, silicon and a wide range of compound semiconductors, oxides, metals, and halides.

Figure 13:
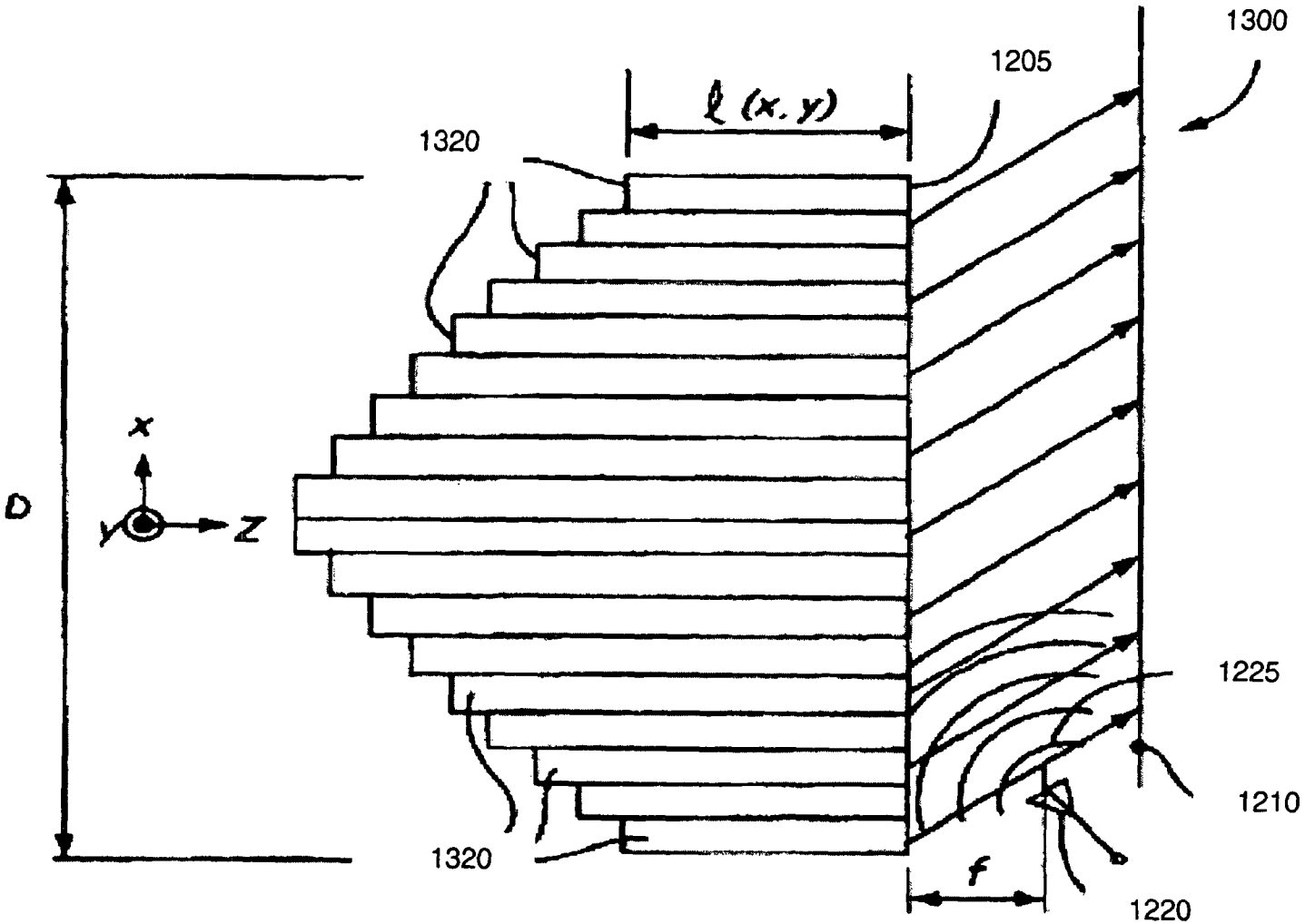
FIG. 13 shows a diagram of a short-circuited transmission line implementation of a reflect array in an embodiment of the present invention.

With reference to FIG. 13, a diagram of a short-circuited transmission line implementation of a reflect array in an embodiment of the present invention is shown. The first implementation of the second basic approach to provide variable phase shift in a reflect array is to incorporate ferroelectric tunable substrate or tunable EBG substrate phase shifters similar to those already described into short-circuited transmission lines or waveguides. A basic reflect array 1300 architecture employing an array of short-circuited waveguides 1320 is shown schematically in FIG. 13. Here again the reflecting surface 1205 is spatially excited by the wave 1225 from the feed horn 1220 or other suitable radiating element resulting in the radiated wave 1210, as shown in FIG. 12.

The input surface impedance of a rectangular aperture is a function of the length, l, of the shorted waveguide section 1320. Other short circuit sections of transmission lines of different topologies can be used, and each has similar impedance expressions as is known in the art. It is possible to implement a phased array 1300 by embedding phase shifters into the short-circuited transmission lines or waveguides 1320.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. Features of any of the variously described embodiments may be used in other embodiments. The form herein before described being merely an explanatory embodiment thereof. It is the intention of the following claims to encompass and include such changes.

What is claimed is:

1. A reflector antenna comprising;

a reflector having a tunable reflective surface, the reflector including a ferrite substrate in which the tunable reflective surface is configured to be adjusted by varying a magnetic field within the ferrite substrate;

a reflector feed, the reflector feed including an array of transverse electromagnetic waveguide radiating elements, wherein each transverse electromagnetic waveguide radiating element includes at least one of a photonic bandgap phase shifter waveguide or an electromagnetic bandgap phase shifter waveguide.

2. The antenna of claim 1, further comprising a sub-reflector.

3. The antenna of claim 2, wherein the reflector feed transmits a phase shifted signal to the sub-reflector.

4. The antenna of claim 3, wherein the sub-reflector reflects the phase shifted signal to the reflector.

5. The antenna of claim 1, wherein the reflector feed is configured to phase shift a signal transmitted by the reflector feed.

6. The antenna of claim 5, wherein a direction of a collimated plane wave is changed by changing the phase shift of the signal transmitted by the reflector feed.

7. The antenna of claim 1, wherein the reflector feed is set offset from a center axis of the reflector.

8. The antenna of claim 1, wherein variance in an amount of the magnetic field within the ferrite substrate adjusts a permeability of the ferrite substrate.

9. The antenna of claim 8, wherein said tunable reflective surface imposes a phase shift on a reflected signal according to the permeability of the ferrite substrate.

10. The antenna of claim 9, wherein said reflector includes at least one electromagnet which is configured to adjust the magnetic field within the ferrite substrate.

11. A reflector antenna comprising;

a reflector having a reflective surface;

a reflector feed capable of transmitting a signal, the reflector feed including an array of transverse electromagnetic waveguide radiating elements; and a sub-reflector having a tunable surface, the reflector including a ferrite substrate in which the tunable surface is configured to be adjusted by varying a magnetic field within the ferrite substrate, wherein each transverse electromagnetic waveguide radiating element includes at least one of a photonic bandgap phase shifter waveguide or an electromagnetic bandgap phase shifter waveguide.

12. The antenna of claim 11, wherein the reflector feed transmits the signal to the sub-reflector.

13. The antenna of claim 11, wherein the reflector reflects a collimated plane wave.

14. The antenna of claim 11, wherein the reflector feed and sub-reflector are offset from a center axis of the reflector.

15. The antenna of claim 11, wherein variance in an amount of the magnetic field within the ferrite substrate adjusts a permeability of the ferrite substrate.

16. The antenna of claim 15, wherein said tunable surface imposes a phase shift on said signal according to the permeability of the ferrite substrate.

17. The antenna of claim 16, wherein said reflector includes at least one electromagnet which is configured to adjust the magnetic field within the ferrite substrate.

* * * * *